United States Patent [19]

Kago et al.

[11] Patent Number: 4,558,321

[45] Date of Patent: Dec. 10, 1985

[54] VISITOR CONVERSATION SYSTEM

[75] Inventors: Yoshiyuki Kago, Aichi; Shigeyuki Akita, Okazaki, both of Japan

[73] Assignee: Nippon Soken, Inc., Nishio, Japan

[21] Appl. No.: 492,827

[22] Filed: May 9, 1983

[30] Foreign Application Priority Data

May 10, 1982 [JP] Japan ..... 57-77980

[51] Int. Cl.[4] ..... G08B 7/00

[52] U.S. Cl. ..... 340/904; 179/37; 367/93

[58] Field of Search ..... 179/37; 367/93, 94, 367/95, 97, 107, 112, 132; 340/904; 381/94, 56, 57

[56] References Cited

U.S. PATENT DOCUMENTS 3,231,852 1/1966 Kritz ..... 367/132
3,622,957 11/1971 Libengood et al. ..... 367/93
3,922,672 11/1975 Birt et al. ..... 340/384 E
4,039,760 8/1977 Gregory et al. ..... 179/2 EA
4,203,160 5/1980 Doherty ..... 367/132

*Primary Examiner*—Gerald L. Brigance
*Assistant Examiner*—Jeffery A. Brier
*Attorney, Agent, or Firm*—Cushman, Darby & Cushman

[57] ABSTRACT

A novel visitor conversation system comprising a single transmitter-receiver. The distance to an incoming person is measured by receiving an ultrasonic wave signal propagated from the transmitter-receiver and reflected on the person. When the distance is shorter than a predetermined detection distance, it is decided that the person is a visitor. The transmitter-receiver further propagates an ultrasonic wave amplitude-modulated on an audio signal, and the signal received is demodulated for the purpose of a speech. The visitor detection and the conversation with a vehicle carrying a speaking device are performed by a single medium.

3 Claims, 10 Drawing Figures

VISITOR CONVERSATION SYSTEM

BACKGROUND OF THE INVENTION

1. Field of the Invention

The present invention relates to a visitor conversation system whereby a visit of a person is detected and a conversation may be conducted. Also, the arrival of a vehicle may be detected and a conversation conducted if the vehicle is carrying an ultrsonic conversation device.

2. Description of the Prior Art

Conventional systems are available in which a visit of a person is detected by a combination of a light emitter and a light receiver as the person interrupts the path of the light between the light emitter and the light receiver. Conventional systems are also available having the sole function of holding a conversation on wire with a visitor by such means as an intercom located on the front door of a house, or in which a person with a transceiver in a vehicle can talk with another person outside the vehicle.

None of these systems have dual functions of detection of and conversation with a visitor, and such a dual-purpose system, if realized conventionally, would require separate circuits for detection and conversation, with the result that the circuit configuration is complicated for an increased production cost.

SUMMARY OF THE INVENTION

Accordingly, it is the object of the present invention to provide a visitor conversation system comprising a sound wave transmitter-receiver, visitor detector means for measuring the distance to a person by an ultrasonic wave transmitted and reflected on him and deciding that he is a visitor when the distance is shorter than a set detection distance, speaking means whereby an ultrasonic wave amplitude-modulated on an audio signal from the sound wave transmitter-receiver is demodulated into an audio signal for the purpose of speech, a control unit for deciding on the presence of speech from the received signal of the sound wave transmitter-receiver, and a change-over switch for switching the connection of the sound wave transmitter-receiver with the visitor detector or the speaking means in response to an output of the control unit. Further, the detection of and conversation with a visitor in an arriving car equipped with a sound wave transmitter-receiver and communication means are also possible at the same time.

BRIEF DESCRIPTION OF THE DRAWINGS

Preferred embodiments of the present invention will now be described in conjunction with the accompanying drawings, in which.

DESCRIPTION OF THE PREFERRED EMBODIMENTS

A visitor conversation system according to the present invention will be explained below with reference to an embodiment.

Figure 1:
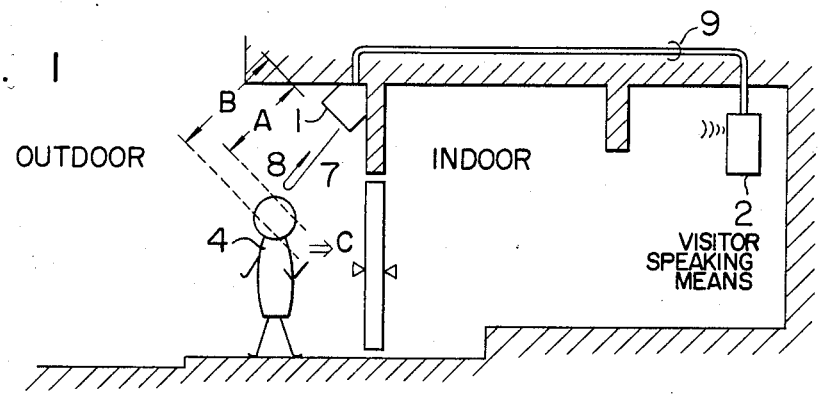
FIG. 1 is a diagram showing a configuration of visitor detector means of a visitor conversation system according to the present invention.

A configuration of a visitor detector of the visitor conversation system according to the present invention is shown in FIG. 1.

In FIG. 1, reference numeral 1 designates a sound wave transmitter-receiver provided outdoor, and numeral 2 a visitor speaking means connected with the outdoor sound wave transmitter-receiver 1 by a cable 9. When a person 4 passes under the sound wave transmitter-receiver 1 in the direction of an arrow C, the ultrasonic wave 7 propagated from the sound wave transmitter-receiver 1 is reflected on the person 4 as shown, and the reflected wave 8 is received by the sound wave transmitter-receiver 1, which measures the distance A between the location of the transmitter-receiver 1 and the person 4 by the time required from transmission to receipt of the ultrasonic wave. When and if this distance A is shorter than a predetermined detection distance B as shown in FIG. 1, a visitor speaking means 2 is actuated and notifies the person indoors of a visit. If the distance A is longer than the detection distance B, by contrast, it is decided that a visitor has not yet arrived and the visitor speaking means 2 is not actuated.

Figure 2:
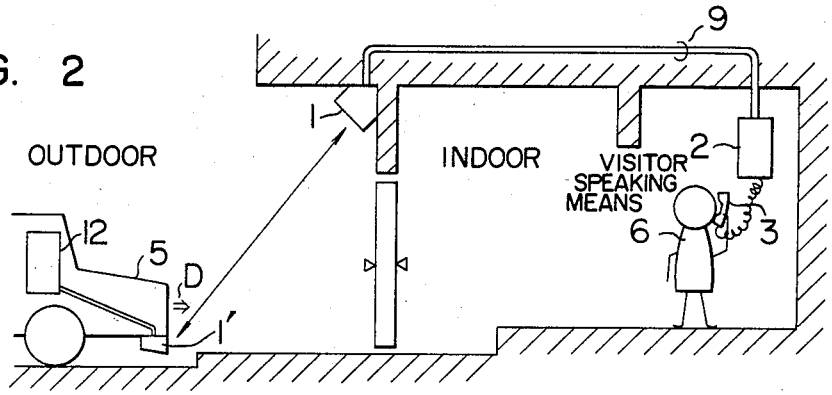
FIG. 2 is a diagram showing a configuration of speaking means of a visitor conversation system according to the present invention.

FIG. 2 shows a configuration of the speaking mode of the visitor conversation system according to the present invention.

In FIG. 2, numeral 5 designates a vehicle running in the direction D outdoors and carrying a communication means 12 having only a speaking means and a sound wave transmitter-receiver 1' connected with the communication means 12. On the other hand, the indoor equipments include a transmitter-receiver 1 for communication with the transmitter-receiver 1' in the vehicle 5, the visitor speaking means 2 connected with the transmitter-receiver 1 by the cable 9, and a handset 3 attached to the visitor speaking means 2 for use by a person 6.

The transmitter-receiver 1' in the vehicle 5, which is designed for performing exactly the same operation as the outdoor transmitter-receiver 1, has a compact construction convenient for use in a vehicle.

The transmitter-receiver 1' in the vehicle transmits a call signal. This call signal is received by the outdoor transmitter-receiver 1, and is sent to the visitor speaking means 2 by way of the cable 9, so that a call sound is issued from the visitor speaking means 2 to the person 6. When the person 6 picks up the handset 3, the communication channel is established with the vehicle 5.

Figure 3:
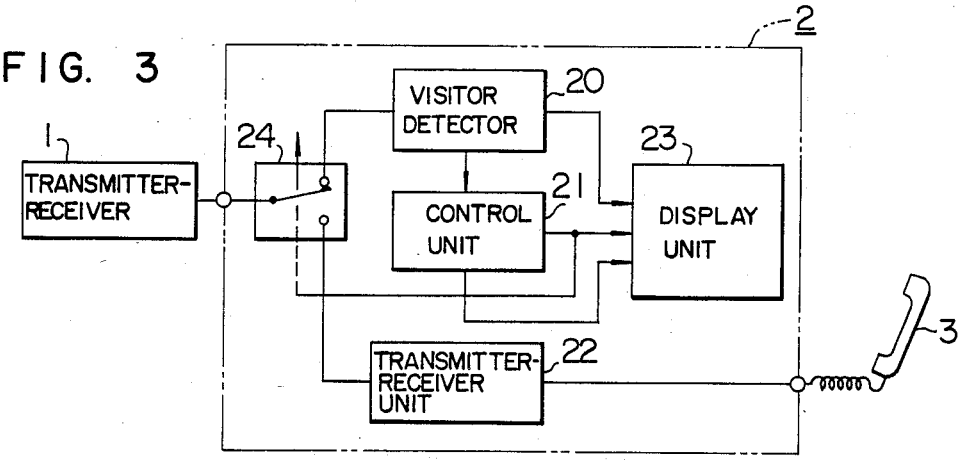
FIG. 3 is a diagram showing a configuration of a visitor conversation system shown in FIGS. 1 and 2.

FIG. 3 shows a configuration of the visitor speaking means 2 shown in FIGS. 1 and 2. In FIG. 3, those component elements identical to those included in FIGS. 1 and 2 are denoted by the same reference numerals as those in the latter diagrams. Numeral 20 designates a visitor detector for detecting a visitor by receiving a detect signal transmitted from the transmitter-receiver 1 shown in FIGS. 1 and 2, numeral 21 a control unit for deciding on the presence or absence of a speech and controlling a display unit 23 which indicates the presence or absence of a visitor and whether the visitor detection or speech is involved on the one hand, and a change-over switch 24 for switching the visitor detector 20 and a transmitter-receiver unit 22 on the other hand. Numeral 22 designates the transmitter-receiver unit 22 connected with the handset 3.

Figure 4:
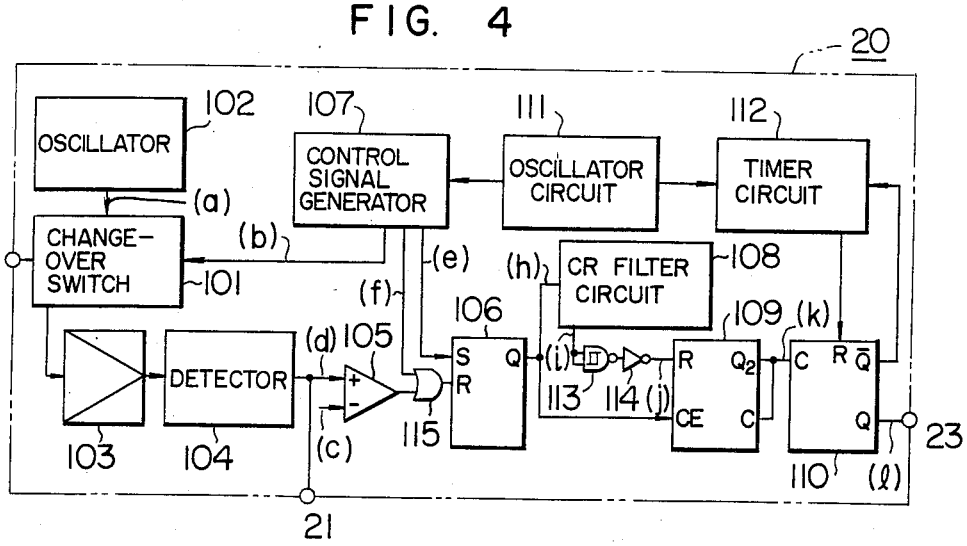
FIG. 4 shows a detailed construction of the visitor detector of FIG. 3.
Figure 5:
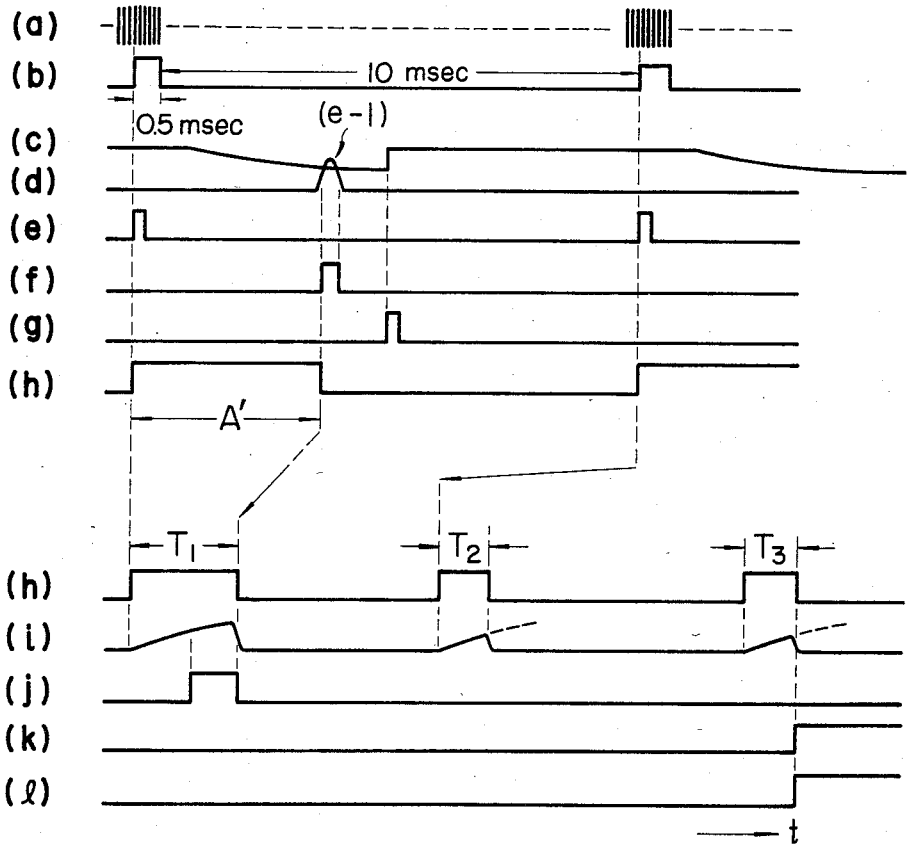
FIG. 5 shows signal waveforms produced at various points in the visitor detector of FIG. 4.

FIG. 4 shows a detailed configuration of the visitor detector of FIG. 3. FIG. 5 illustrates signal waveforms produced at points (a) to (l) of the visitor detector 20 shown in FIG. 4.

In FIG. 4, an output of an oscillator circuit 111 is applied to a control signal generator circuit 107 and a timer circuit 112. The control signal generator circuit 107 produces a signal (b) for controlling a change-over switch 101, and a pair of signals (e) and (f) for controlling a flip-flop 106. The change-over switch 101 is connected with an oscillator 102 and an amplifier 103 on the one hand and with the transmitter-receiver 1 shown in FIGS. 1 and 2 on the other hand. The signal (a) is applied from the oscillator 102 to the change-over switch 101. The output of the amplifier 103 is applied through a detector 104 to a non-inverted input terminal (+) of a comparator 105 as a signal (d). The inverter input terminal (−) is supplied with the signal shown in (c) of FIG. 5. The output of the comparator 105 and the output of the control signal generator circuit 107 are applied to an OR gate 115 for producing a logic sum, which is applied to the reset terminal R of the flip-flop 106. The Q output terminal of the flip-flop 106 is connected to a CR filter circuit 108 and the CE terminal of a counter 109. An input (h) is supplied to the CR filter circuit 108. The output (i) of the CR filter circuit 108 is applied through a Schmidt trigger circuit 113 and an inverter circuit 114 to the reset terminal R of the counter 109 as a signal (j). The terminals C and $Q_2$ of the counter 109 are connected to each other on the one hand and to the terminal C of the flip-flop 110 on the other hand as a signal (k). The output $\overline{Q}$ of the flip-flop 110 is applied to the timer circuit 112. The output of the timer circuit 112 is applied to the reset terminal R of the flip-flop 110. The Q output signal (l) of the flip-flop 110 is in turn applied to the display unit 23 shown in FIG. 3.

Figure 6:
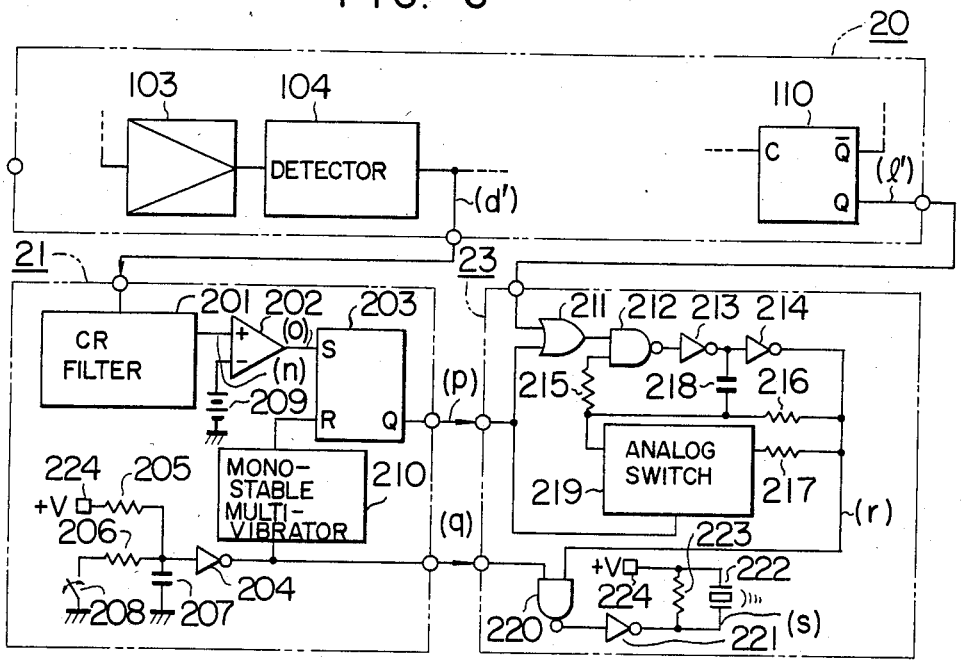
FIG. 6 is a diagram generally showing the circuits of a control unit and a display unit included in the device of FIG. 3.
Figure 7:
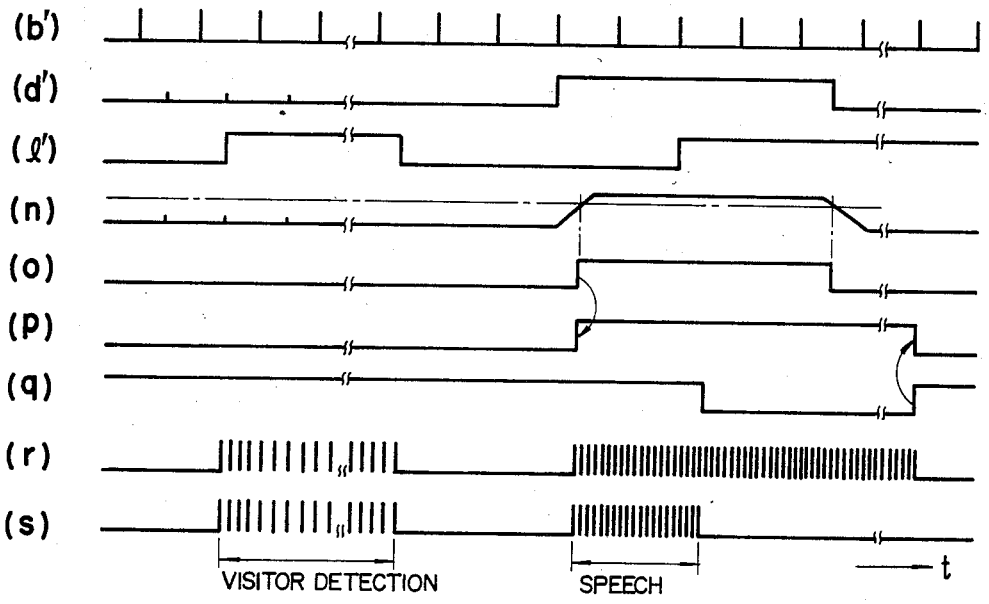
FIG. 7 shows waveforms produced at various parts of FIG. 6.

The circuits of the control unit 21 and the display unit 23 of FIG. 3 are schematically shown in FIG. 6, and signal waveforms produced at various parts thereof in FIG. 7.

In FIG. 6, the output (d') of the detector 104 is applied to the CR filter circuit 201. The output (n) of the CR filter circuit 201 is applied to the non-inverted input terminal (+) of the comparator 202 and compared with a reference signal of a reference source 209. The output (o) of the comparator 202 is applied to the set terminal S of the flip-flop 203. A circuit including a hook switch 208, resistors 205, 206, a capacitor 207, an inverter 204 and a monostable multivibrator 210 is connected to the reset terminal R of the flip-flop 203. In the display unit 23 of FIG. 6, the Q output (l') of the flip-flop 110 of the visitor detector 20 and the Q output (p) of the flip-flop 203 of the control unit 21 are applied to the OR gate 211 to produce a logic sum thereof. An oscillator circuit including an AND gate 212, inverters 213, 214, resistors 215, 216, 217, a capacitor 218 and an analog switch 219 is controlled by the Q output (p) of the inverter 204 and the output of the OR gate 211. The output (q) of the inverter 204 and the output (r) of the inverter 214 are applied through a NAND gate 220 and an inverter 221 to a piezoelectric buzzer 222 and a resistor 223. In FIG. 6, numeral 224 designates a terminal impressed with a positive voltage +V.

Figure 8:
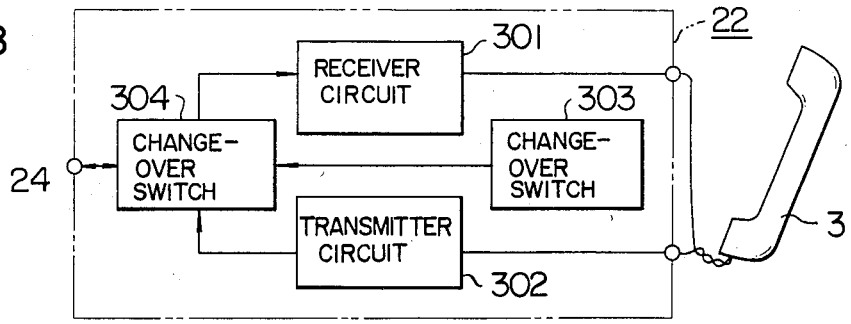
FIG. 8 is a schematic block diagram of a transmitter-receiver included in the device of FIG. 3.

FIG. 8 shows a schematic block diagram of the transmitter-receiver unit 22 shown in FIG. 3.

In FIG. 8, the transmitter-receiver unit 22 is comprised of a receiver circuit 301, a transmitter circuit 302, a transmission-receiving change-over switch 303, and a change-over switch 304. The receiving circuit 301 and the transmitter circuit 302 are connected to the handset 3 respectively. The change-over switch 304, which is connected with the receiver circuit 301 and the transmitter circuit 302, is controlled by the transmission-receiving change-over switch 303, and is further connected to the change-over switch 24 shown in FIG. 3.

The processes of operation of the visitor conversation system according to the present invention as constructed above will be explained below.

First, the operation for detecting a visitor will be explained with reference to FIGS. 4 and 5. In FIG. 4, a transmission-receiving switching signal (FIG. 5(*b*)) for controlling the change-over switch 101 is produced at the control signal generator circuit 107 in response to the signal from the oscillator circuit 111. This signal (b) is used for alternate transmission and receiving. A rectangular wave signal (a) of a predetermined frequency produced from the transmission pulse generator circuit 102 is applied to the transmitter-receiver 1 shown in FIG. 1 through the change-over switch 101 controlled by the transmission-receiving change-over signal (b) so that the transmitter-receiver 1 propagates the ultrasonic wave 7 in a predetermined direction. After the transmitter-receiver 1 has propagated the ultrasonic wave 7 of 0.5 m sec duration at regular time intervals of 10 msec for a predetermined period of time, the change-over switch 101 is turned to the receiving side, with the result that transmitter-receiver 1 functions as a receiver of the reflected wave 8. The reflected signal received at the transmitter-receiver 1, after being amplified by the amplifier 103, is waveform-shaped by the detector 104 and applied to the comparator 105. In view of the fact that the sound pressure of the reflected wave 8 decreases according as the distance between the transmitter-receiver 1 and the person 4 or the like lengthens, the reference level signal (c) for the comparator 105 has a progressively decreasing level as shown in the timing chart of FIG. 5. In the reflected signal (d) of FIG. 5, (e−1) designates the echo reflected from the person 4, and when this reflected echo (e−1) crosses the reference level signal (c), the first flip-flop circuit 106 is reset thereby to produce a pulse signal (h) having a duration A' corresponding to the distance A. If the sound runs at the velocity of 334 m/sec, A(m) is substantially given as 167 A' (msec). In the event that the distance exceeds a measurable length based on the transmission and receiving ability of the transmitter-receiver 1, the level of the signal (c) is raised and the first flip-flop circuit 106 is reset by the signal (f) thereby to suspend the distance measurement. The flip-flop circuit 106 produces a pulse at the Q output thereof through a circuit including the CR filter circuit 108, the Schmidt circuit 113 and the inverter 114 only when the measured distance is longer than the predetermined length. The fall of the distance signal (h) from logic "1" to "0" is counted by the counter 109 (TC4520). As seen from FIG. 5(*h*), when the signal (h) has a long duration ($T_1$), the reset pulse (j) is generated so that the fall of the distance signal (h) is not counted, while when the duration thereof is short ($T_2$, $T_3$) the reset pulse (j) fails to be generated thereby to count the fall of the distance signal (h). When two pulses of a duration shorter than the predetermined distance are produced successively from the transmitter-receiver 1, the signal is raised to "1" to set the second flip-flop circuit 110 (TC4013), so that the signal (l) is raised to "1" thereby to start the annunciator means. When the second flip-flop circuit 110 is set, the timer circuit 112 is actuated, and after a predetermined time, produces a timer signal so that the second flip-flop circuit 110 is reset thereby to stop the annunciator. The counter 109 holds the two counts even if a duration shorter than the predetermined distance is applied thereto repeatedly. Therefore, the second flip-flop circuit 110 is prevented from being set after being reset by the timer signal. In other words, the alarming process is completed in a single operation. The next alarming operation is possible only after the counter 109 is reset in response to a signal of a duration longer than the predetermined distance.

Now, the operation for speaking will be described.

First, the distinction between visitor detection and speech will be explained with reference to FIGS. 6 and 7. Normally, the presence or absence of a visitor is under detection. When a call is given from the sound wave transmitter-receiver 1' carried on the vehicle 5, however, a call signal of a very long pulse form (FIG. 7(*d'*)) appears on the detector 104 of FIG. 4. A pulse is produced through the CR filter circuit 201 and the comparator 202 only when this call signal (d') is longer than a predetermined value. Such a pulse fails to be generated in response to a visit of a person. When the comparator 202 produces a "1" signal, the flip-flop 203 (TC4013) is set and the Q output produces a "1" signal. Also, a hook switch 208 decides whether or not the handset 3 is encased. When the handset 3 is encased, the switch 208 is closed and the inverter produces a "1" output. As a result, the analog switch 219 is turned on and the system oscillates at a frequency determined by the resistors 216, 217 and the capacitor 218, thus generating a call sound from the piezoelectric buzzer 222. When the person 6 picks up the handset 3 from the case as shown in FIG. 2, however, the hook switch 208 is opened so that the output of the inverter 204 is reduced to "0" thereby to stop the call sound. In visitor detection mode, on the other hand, the analog switch 219 is turned off, and therefore the oscillation occurs at the frequency determined by the resistor 216 and the capacitor 218, thus indicating a visit of a person by the piezoelectric buzzer 222. As explained above, calls for visitor detection and speech are distinguished from each other by the difference of the oscillation frequency.

Now, the operation for speech will be described. In FIG. 2 in the event of a call generated from the transmitter-receiver 1' mounted on the vehicle 5, the Q output of the flip-flop 203 in FIG. 6 is raised to "1". This output signal is used to control the change-over switch 24 shown in FIG. 3. When the Q output of the flip-flop 203 is raised to "1", the change-over switch 24 which has thus far been in visitor detection mode is turned to the transmission-receiving mode. The system thus becomes ready for conversation and gives a call sound. Under this condition, when the person 6 indoor picks up the handset 3, the call sound stops. For talking from indoor to the vehicle, for instance, the change-over switch 304 is turned to transmission mode by the transmission-receiving change-over switch 303 thereby to propagate an ultrasonic wave from the transmitter-receiver 1. The vehicle 5 carries the same transmitter-receiver unit as the indoor transmitter-receiver 22, and the signal received at the transmitter-receiver 1 is demodulated into an audio signal at the receiver circuit 301, which signal is heard on the handset 3, thereby establishing a communication channel. The reverse is the case for talking from the vehicle 5 to an indoor person.

Figure 9:
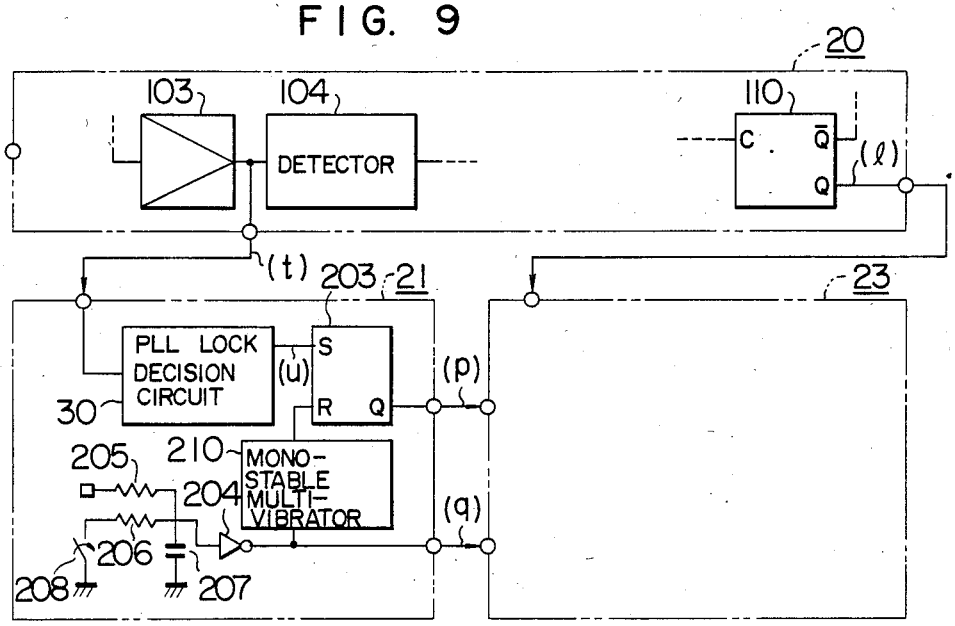
FIG. 9 is a diagram showing a configuration of the visitor conversation system according to another embodiment of the present invention.
Figure 10:
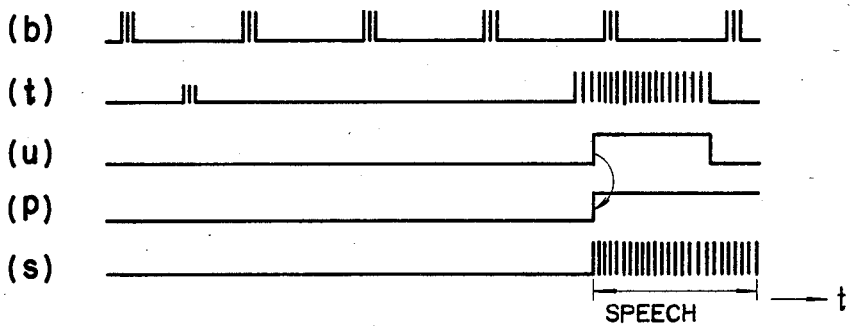
FIG. 10 is a diagram showing signal waveforms produced at various parts of the visitor conversation system of FIG. 9.

FIG. 9 shows a configuration of the visitor conversation system according to another embodiment of the present invention, and FIG. 10 signal waveforms produced at various parts for explaining the visitor conversation system shown in FIG. 9.

The embodiment of FIG. 9 is different from the above-described first embodiment in that, the first embodiment uses an output signal of the detector 104 of the visitor detector circuit 20 as shown in FIG. 6, whereas an output signal (FIG. 10(*t*)) of the amplifier 103 of the visitor detector circuit 20 is used in the embodiment under consideration. Further, the CR filter circuit 201 and the comparator 202 of FIG. 6 are replaced by a PLL (Phase Lock Loop) lock decision circuit 30 in the present embodiment. The PLL lock decision circuit 30 is easily obtained, for example, by RCA's CD4046. The operation of the PLL lock decision circuit 30 will be explained with reference to FIG. 10.

The PLL lock decision circuit 30 decides whether or not the received frequency is within a predetermined level, on the basis of the signal (t) in FIG. 10. In the case of visitor detection, the signal time is short, and therefore, the PLL lock decision circuit 30 fails to be actuated in response to any signal that may be applied thereto. In the case of a call for a speech involving a long signal time, on the other hand, the signal (u) shown in FIG. 10 is produced from the PLL lock decision circuit 30. The subsequent operation is identical to the one of the first embodiment described above. Further, it is possible according to the embodiment under consideration to use the system as an interphone but not for the purpose of communication with a vehicle by disposing the same transmitter at the front door as in the vehicle.

It will be understood from the foregoing description that according to the present invention, a visitor conversation system is provided, comprising a sound wave transmitter-receiver, visitor detection means for measuring the distance to an incoming person in response to an ultrasonic wave transmitted from the sound wave transmitter-receiver and reflected on the person and deciding that the person is a visitor when the distance is shorter than a predetermined detection distance, and communication means for propagating an ultrasonic wave amplitude-modulated by an audio signal in cooperation with the transmitter-receiver and demodulating the received signal, thereby permitting the visitor detection and communication to be performed by a single medium.

We claim:

1. A visitor conversation system comprising:

a transmitter-receiver;

a vehicle carrying communication means for transmitting and receiving ultrasonic speech information signals to and from said transmitter-receiver;

visitor detector means for measuring the distance between said transmitter-receiver and a visitor by receiving reflections from said visitor of ultrasonic waves propagated from said transmitter-receiver and for generating a visitor detection signal when said visitor is within a predetermined detection distance;

a handset provided indoors for generating an audio signal from speech information;

transmitter-receiver means, connected to said transmitter-receiver, for amplitude-modulating said audio signal from said handset to propagate said ultrasonic speech information signals from said transmitter-receiver and for demodulating said ultrasonic speech information signals received by said transmitter-receiver to generate a voice from said handset related to speech information from said communication means;

control means for generating a speech detection signal when said transmitter-receiver receives said ultrasonic speech information signals from said communication means;

change-over switch means for electrically connecting said transmitter-receiver and said visitor detector means when said control means is not generating said speech detection signal and for electrically connecting said transmitter-receiver and said transmitter-receiver means when said control means generates said speech detection signal;

display means, responsive to said visitor detector means and said control means, for performing a first display for indicating a visitor in response to said visitor detection signal and for performing a second display for indicating speech information in response to said speech detection signal;

hook switch means for generating a rest signal when said handset is in a rest position; and means for ending said second display in said display means when said hook switch means does not generate said rest signal.

2. A visitor conversation system according to claim 1, wherein said visitor detector means generates said visitor detection signal only after said visitor has been within said detection distance for a predetermined time.

3. A visitor conversation system according to claim 1, within said display means includes sound generating means for generating a first frequency sound in response to said visitor detection signal and for generating a second frequency sound in response to said speech detection signal.

* * * * *